US010553965B2

(12) United States Patent
Huang

(10) Patent No.: US 10,553,965 B2
(45) Date of Patent: Feb. 4, 2020

(54) QUICK CONNECT PLUG FOR CABLES

(71) Applicant: HEFEI SANYU ELECTRIC CO., LTD, Hefei (CN)

(72) Inventor: Jun Huang, Hefei (CN)

(73) Assignee: HEFEI SANYU ELECTRIC CO., LTD, Hefei (CN)

( * ) Notice: Subject to any disclaimer, the term of this patent is extended or adjusted under 35 U.S.C. 154(b) by 0 days.

(21) Appl. No.: 16/078,015

(22) PCT Filed: Jan. 17, 2017

(86) PCT No.: PCT/CN2017/071353
§ 371 (c)(1),
(2) Date: Aug. 21, 2018

(87) PCT Pub. No.: WO2017/143886
PCT Pub. Date: Aug. 31, 2017

(65) Prior Publication Data

US 2019/0051998 A1 Feb. 14, 2019

(30) Foreign Application Priority Data

Feb. 26, 2016 (CN) ..... 2016 2 0148653 U

(51) Int. Cl.
*H01R 11/11* (2006.01)
*H01R 13/213* (2006.01)
(Continued)

(52) U.S. Cl.
CPC ..... *H01R 11/11* (2013.01); *H01R 4/36* (2013.01); *H01R 13/05* (2013.01); *H01R 13/213* (2013.01); *H01R 13/6215* (2013.01)

(58) Field of Classification Search
CPC ..... H01R 11/11; H01R 4/36; H01R 13/05; H01R 13/213; H01R 13/6215; H01R 4/48; H01R 4/489; H01R 4/4872
(Continued)

(56) References Cited

U.S. PATENT DOCUMENTS 1,864,989 A * 6/1932 Gottfried Maag-Eckenfelder ..... H01R 13/15 439/823
3,052,867 A * 9/1962 Julian Rogoff ..... H01R 13/18 439/745
(Continued)

FOREIGN PATENT DOCUMENTS

CN 201243128 Y 5/2009
CN 203218520 U 9/2013
(Continued)

*Primary Examiner* — Travis S Chambers
(74) *Attorney, Agent, or Firm* — Gokalp Bayramoglu

(57) ABSTRACT

A quick connect plug for cables includes a connecting portion configured to connect a cable and a plug pin configured to form a plug-in connection with a socket. The plug pin is fixedly provided with a plug-in unit. A portion of the plug-in unit protruding out of an external annular surface of the plug pin forms a locking head matched with a socket slot. A gap is provided between a portion of the plug-in unit near the locking head and the plug pin, so as to enable the locking head to move along an axis direction of the plug pin, and the gap can limit the maximum displacement of the locking head. By providing a plug-in unit and a gap between the portion of the plug-in unit near the locking head and the plug pin, the plug-in unit is enabled to move, thus having certain elasticity.

8 Claims, 5 Drawing Sheets

(51) Int. Cl.
*H01R 4/36* (2006.01)
*H01R 13/05* (2006.01)
*H01R 13/621* (2006.01)

(58) Field of Classification Search
USPC ..... 439/797, 810, 813, 816, 817–819, 823, 439/824, 859, 332, 337
See application file for complete search history.

(56) References Cited

U.S. PATENT DOCUMENTS

| | | | | | |
|---|---|---|---|---|---|
| 3,693,136 | A * | 9/1972 | Appleton | H01R 13/15 | 439/346 |
| 3,969,015 | A | 7/1976 | Le Noane | | |
| 5,893,782 | A * | 4/1999 | Harting | H01R 13/17 | 439/265 |
| 10,122,110 | B2 * | 11/2018 | Binzel | H01R 4/302 | |
| 2011/0312199 | A1 * | 12/2011 | Alrutz | H01R 13/622 | 439/188 |

FOREIGN PATENT DOCUMENTS

| | | | |
|---|---|---|---|
| CN | 104218355 | A | 12/2014 |
| CN | 105322363 | A | 2/2016 |
| CN | 205429238 | U | 8/2016 |

* cited by examiner

QUICK CONNECT PLUG FOR CABLES

CROSS REFERENCE TO RELATED APPLICATIONS

This application is the national phase entry of International Application PCT/CN2017/071353, filed on Jan. 17, 2017 which is based upon and claims priority to Chinese Patent Application No. 201620148653.9, filed on Feb. 26, 2016 the entire contents of which are incorporated herein by reference.

TECHNICAL FIELD

The present invention relates to the technical field of cable connect, in particular to a quick connect plug for cables.

BACKGROUND

In the prior art, welding cables are fitted and connected to other welding cables or welding equipment through plug and socket. The inner wall of the insertion hole of the socket is provided with a guide slot along the axis direction of the insertion hole. The end of the guide slot is connected to a spiral slot. The spiral slot is arranged at the inner annular surface of the insertion hole, and the axis of the spiral slot coincides with the axis of the insertion hole. The front end of the plug is provided with a protruded locking head. During connection, the plug is inserted along the guide slot of the socket, and then the plug is rotated so as to make the locking head of the plug rotate along the spiral slot. The end face of the plug closely fit the end face of the socket after tightening. In this structure, as both, the plug and the socket are of integral steel structure, the operating distance between tightening and loosening is only 1-2.5 mm during use. During production and operation, the locking head of the plug easily gets loose from the slot due to factors such as handling, vibration, collision, expansion and contraction, and pulling of cables etc. The loosening of the locking head causes insufficient connection and unstable current on the contacting surface. When large current flows through, the plug and socket will heat up, and may burn the connector, thereby causing fire hazards.

SUMMARY

The objective of the present invention is to provide a quick connect plug for cables which can realize convenient and reliable plug-in connect.

In order to achieve the above-mentioned objective, the present invention adopts the following technical solution. A quick connect plug for cables includes a connecting portion configured to connect a cable and a plug pin configured to form a plug-in connection with a socket. The plug pin is fixedly provided with a plug-in unit. A portion of the plug-in unit protruding out of an external annular surface of the plug pin forms a locking head matched with the socket slot. A gap is provided between a portion of the plug-in unit near the locking head and the plug pin, so as to enable the locking head to move along an axis direction of the plug pin, and the gap can limit the maximum displacement of the locking head.

Compared with the prior art, the present invention has following technical effects. By providing a plug-in unit and providing a gap between the portion of the plug-in unit near the locking head and the plug pin, the plug-in unit is enabled to move, thus having certain elasticity. During assembly, due to the existence of elastic force, even though external force is applied on the plug, the plug-in unit will not be damaged, so the phenomenon where the locking head of the plug gets loose from the slot will not occur, thereby ensuring an extremely reliable connection between the welding cables or between the welding cable and welding equipment.

DETAILED DESCRIPTION OF EMBODIMENTS

Figure 1A:
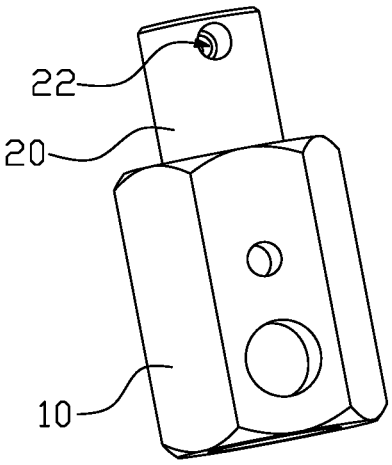
FIGS. 1A-1C are structural schematic diagrams of Embodiment 1 of the present invention.
Figure 1B:
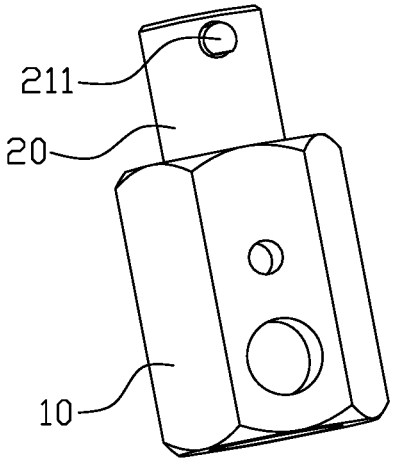
Figure 1C:
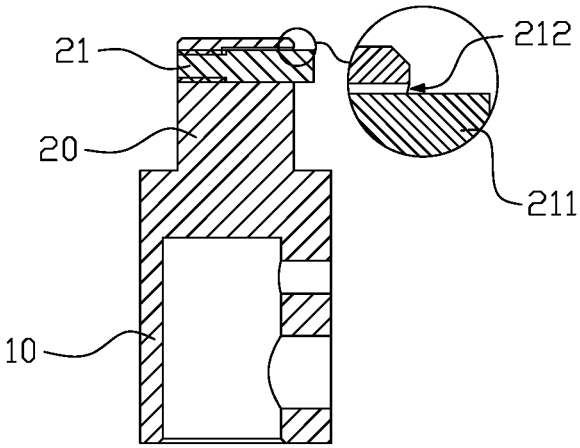
Figure 2A:
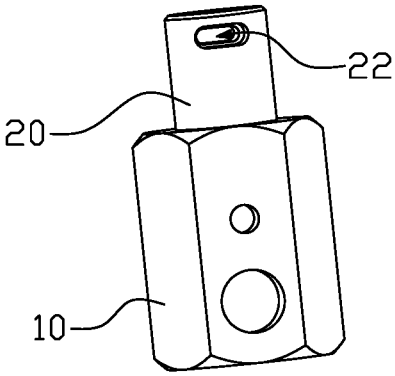
FIGS. 2A-2B are structural schematic diagrams of Embodiment 2 of the present invention.
Figure 2B:
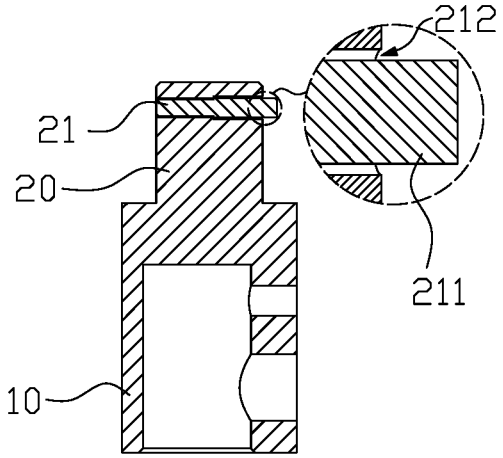

The present invention will be described in detail with reference to FIG. 1A to FIG. 6, hereinafter.

With reference to FIG. 1A to FIG. 6, a quick connect plug for cables includes connecting portion 10 configured to connect the cable and plug pin 20 configured to form a plug-in connection with a socket. The plug pin 20 is fixedly provided with plug-in unit 21, and the portion of the plug-in unit 21 protruding out of the external annular surface of the plug pin 20 forms a locking head 211 which is matched with the socket slot. The plug-in unit 21 is fixedly connected to the plug pin 20. Gap 212 is provided between the portion of the plug-in unit 21 near the locking head 211 and the plug pin 20, so as to enable the locking head 211 to move along the axis direction of the plug pin 20. The gap 212 can limit the maximum displacement of the locking head 211. By providing the plug-in unit 21 and the gap 212 between the portion of the plug-in unit 21 near the locking head 211 and the plug pin 20, the plug-in unit 21 is enabled to move and has a certain elasticity. During assembly, due to the existence of elastic force, even though external force is applied on the plug, the plug-in unit 21 will not be damaged, so the phenomenon where the locking head 211 of the plug gets loose from the slot will not occur, thereby ensuring an extremely reliable connect between the welding cables or between the welding cable and welding equipment.

Figure 6:
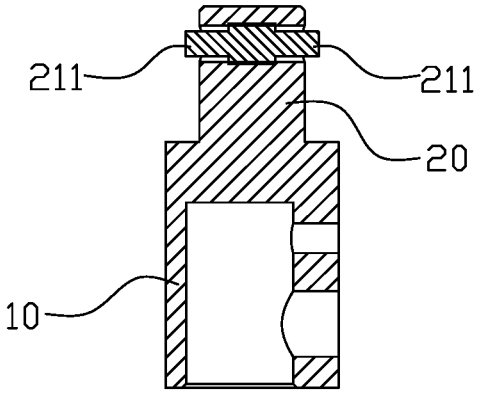
FIG. 6 is a structural schematic diagram of Embodiment 6 of the present invention.

As a preferred embodiment of the present invention, one end of the plug-in unit 21 protruding out of the external annular surface of the plug pin 20 forms the locking head 211, and the other end of the plug-in unit 21 is fixedly connected to the plug pin 20. In this structure, there is only one locking head 211. Due to existence of the gap 212 at the side of the locking head 211, one locking head 211 is sufficient to ensure reliable connection between the plug and the socket. Alternatively, the following solution may also be used. Both ends of the plug-in unit 21 protrude out of the external annular surface of the plug pin 20 to form locking heads 211, and the two locking heads 211 are symmetrical with respect to the center of the plug pin 20. The middle portion of the plug-in unit 21 is fixedly connected to the plug pin 20. Here, two locking heads 211 are provided. Although the arrangement of two locking heads 211 is a bit more complex, the reliability increases. According to Embodiments 1, 2, 3, 4 and 5, one locking head 211 is used, and according to Embodiment 6, two locking heads 211 are used, the section view thereof is shown in FIG. 6. Since Embodiment 6 is similar to Embodiment 3 except for two locking heads 211 are used, merely one figure is provided herein and the details are not described. Embodiment 3 may be referred for the specific structure. Similarly, the structure of two locking heads 211 may be used in other embodiments.

Many structures may be used to form the gap 212 between the plug-in unit 21 and the plug pin 20, and multiple embodiments are described in detail in the present invention.

With reference to FIGS. 1A-1C and 2A-2B, preferably, the plug pin 20 is provided with stepped hole 22. The stepped hole 22 includes a small hole section and a large hole section. The plug-in unit 21 is a straight rod. One end of the straight rod is inserted into the small hole section and they are in an interference fit. Alternatively, the straight rod and the small hole section are in a screw thread fit. Any matching mode is acceptable as long as one end of the straight rod and the small hole section can be fixedly connected to each other. The other end of the straight rod passes through the large hole section and extends out of the external annular surface of the plug pin 20 to form the locking head 211. Moreover, the diameter of the straight rod is less than the diameter of the large hole section. The axes of the small hole section and the large hole section are perpendicular to the axis of the plug pin 20. By providing the stepped hole 22 and configuring the plug-in unit 21 as a straight rod, the gap 212 is formed between the straight rod and the large hole section. In practical application, the gap 212 must exist at the side of the plug-in unit 21 away from the connecting portion 10, and the gap may be or may not be provided on the other side. Therefore, the small hole section and the large hole section may be concentrically arranged, or the side of the small hole section near the connecting portion 10 may be aligned with the side of the large hole section near the connecting portion 10. For the latter solution, actually, it can be understood as the large hole section and the small hole section being eccentrically arranged. When the small hole section and the large hole section are concentrically arranged, there is gap 212 surrounding the plug-in unit 21. When the side of the small hole section near the connecting portion 10 is aligned with the side of the large hole section near the connecting portion 10, and the side of the plug-in unit 21 away from the connecting portion 10 has the gap 212. Usage demands are satisfied in both scenarios.

The section profiles of the plug-in unit 21 and the stepped hole 22 may come in many shapes, for example, round, waist shape, square or elliptic. The section profile is round in Embodiment 1, and the section profile is waist-shaped in Embodiment 2. Certainly, other shapes are also acceptable, and they are not described in detail hereinafter.

Figure 3A:
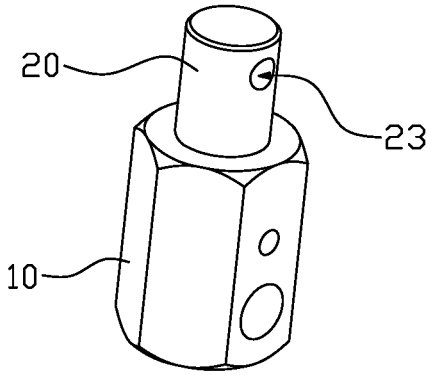
FIGS. 3A-3C are structural schematic diagrams of Embodiment 3 of the present invention.
Figure 3B:
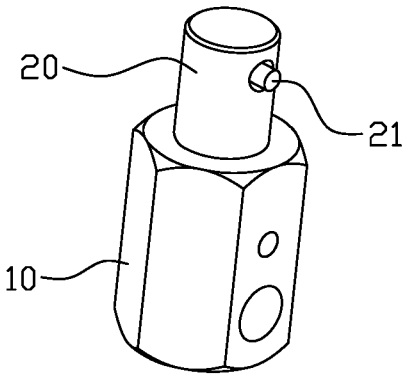
Figure 3C:
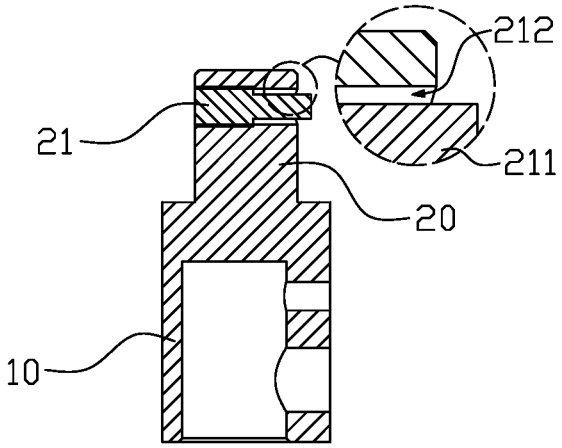

With reference to FIGS. 3A-3C, in Embodiment 3, the plug pin 20 is provided with through hole 23, and the plug-in unit 21 is a straight rod. The straight rod includes the large-diameter rod section and the small-diameter rod section. The large-diameter rod section is inserted into the through hole 23 and the large-diameter rod section and the through hole 23 are in an interference fit. Alternatively, the large-diameter rod section and the through hole 23 are in a screw thread fit. The small-diameter rod section passes through the through hole 23 and extends out of the external annular surface of the plug pin 20 to form locking head 211. Moreover, the diameter of the small-diameter rod section is less than the diameter of the through hole 23. The axis of the through hole 23 is perpendicular to the axis of the plug pin 20. The small-diameter rod section and the large-diameter rod section are concentrically arranged, or the side of the small-diameter rod section near the connecting portion 10 is aligned with the side of the large-diameter rod section near the connecting portion 10. The section profiles of the straight rod and the through hole 23 may be round, waist-shaped, square, or elliptic. This structure is similar to the previous structure, the difference is that the hole is the stepped hole 22 and the plug-in unit is a straight rod in the previous two embodiments. Here, the hole is through hole 23, and the plug-in unit 21 is a stepped rod.

With reference to FIGS. 4A-4C and 5A-5E, the end face of the side of the plug pin 20 away from the connecting portion is provided with the recess 24. The plug-in unit 21 is plate-like and located in the recess 24. In addition, one end of the plug-in unit 21 extends out of the external annular surface of the plug pin 20 to form the locking head 211. The side of the plug-in unit 21 away from the connecting portion is provided with a pressing plate 25. The side of the plug-in unit 21 away from the locking head 211 fits the pressing plate 25 and is fixed on the plug pin 20 with a screw. Gap 212 is formed between the portion of the plug-in unit 21 near the locking head 211 and the pressing plate 25. The fixation of the plug-in unit 21 and the formation of gap 212 are achieved by providing the recess 24 and pressing plate 25. The plug-in unit 21 has a uniform thickness, and the side of the pressing plate 25 near the locking head 211 is wedge-shaped, or the plate thickness of the side of the pressing plate 25 near the locking head 211 is less than the plate thickness of the side of the pressing plate 25 away from the locking head 211 to form the gap 212. The pressing plate 25 has a uniform thickness, and the side of the plug-in unit 21 near the locking head 211 is wedge-shaped, or the plate thickness of the side of the plug-in unit 21 near the locking head 211 is less than the plate thickness of the side of the plug-in unit 21 away from the locking head 211 to form the gap 212.

Figure 4A:
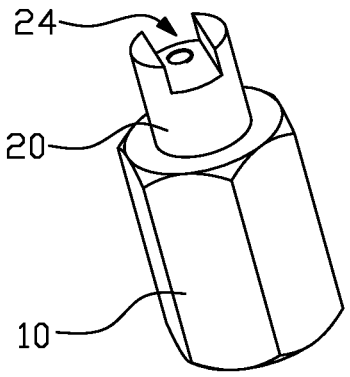
FIGS. 4A-4E are structural schematic diagrams of Embodiment 4 of the present invention.
Figure 4B:
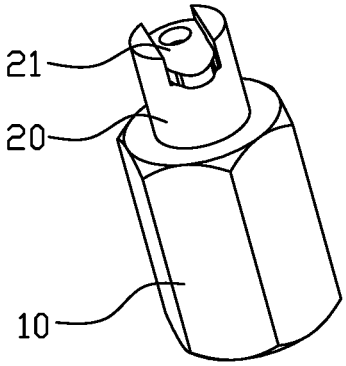
Figure 4C:
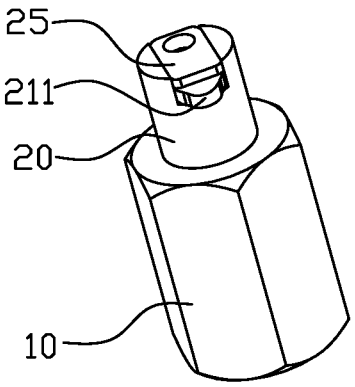
Figure 4D:
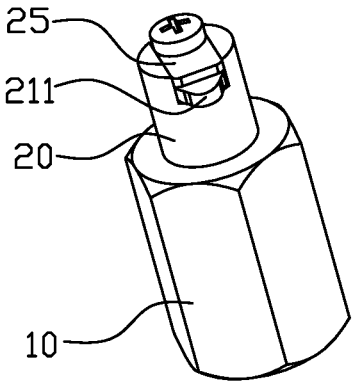
Figure 4E:
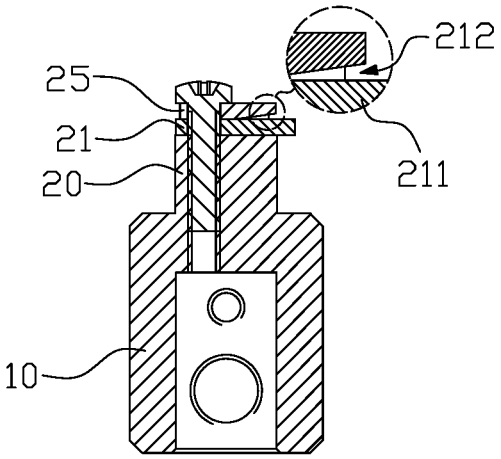
Figure 5A:
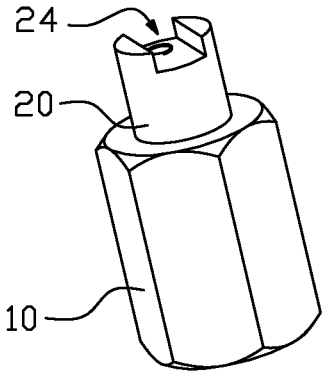
FIGS. 5A-5E are structural schematic diagrams of Embodiment 5 of the present invention.
Figure 5B:
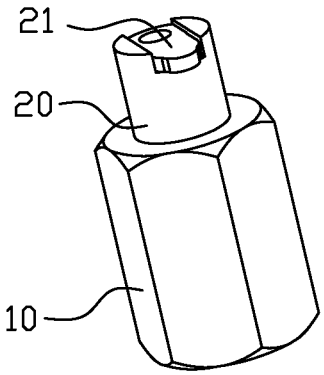
Figure 5C:
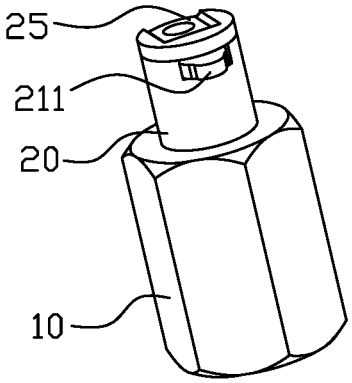
Figure 5D:
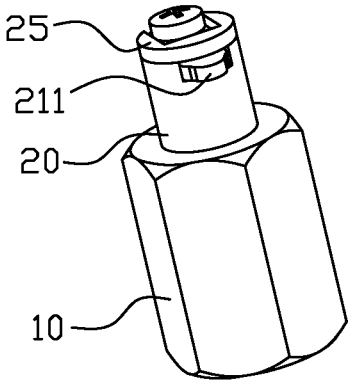
Figure 5E:
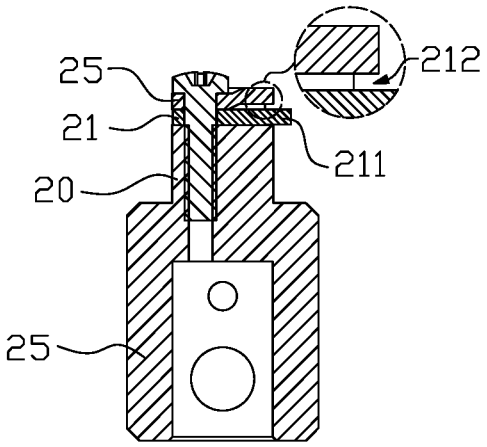

As shown in FIGS. 4A-4C of Embodiment 4, the side of the pressing plate 25 near the locking head 211 is wedge-shaped. As shown in FIGS. 5A-5E of Embodiment 5, the plate thickness of the side of the pressing plate 25 near the locking head 211 is less than the plate thickness of the side of the pressing plate 25 away from the locking head 211. In these two embodiments, the thickness of the plug-in unit 21 is uniform. Certainly, the user may also select the pressing plate 25 with a uniform thickness, and the plug-in unit 21 with changing thickness to form the gap 212.

What is claimed is:

1. A quick connect plug for cables, comprising:

a connecting portion configured to connect a cable and a plug pin configured to form a plug-in connection with a socket; wherein the plug pin is fixedly provided with a plug-in unit;

a portion of the plug-in unit protruding out of an external annular surface of the plug pin forms a locking head matched with a socket slot;

a gap is provided between a portion of the plug-in unit near the locking head and the plug pin, so as to enable the locking head to move along an axis direction of the plug pin, and the gap can limit a maximum displacement of the locking head;

wherein a first end of the plug-in unit protrudes out of the external annular surface of the plug pin to form the locking head, and a second end of the plug-in unit is fixedly connected to the plug pin;

wherein the plug pin is provided with a stepped hole;

the stepped hole comprises a small hole section and a large hole section;

the plug-in unit is a straight rod;

a first end of the straight rod is inserted into the small hole section to form an interference fit with the small hole section, or the straight rod and the small hole section are in a screw thread fit;

a second end of the straight rod passes through the large hole section and extends out of the external annular surface of the plug pin to form the locking head; and a diameter of the straight rod is less than a diameter of the large hole section.

2. The quick connect plug for cables according to claim 1, wherein section profiles of the plug-in unit and the stepped hole are round, waist-shaped, square, or elliptic.

3. The quick connect plug for cables according to claim 1, wherein axes of the small hole section and the large hole section of the stepped hole are perpendicular to an axis of the plug pin;

the small hole section and the large hole section are concentrically arranged; or a side of the small hole section near the connecting portion is aligned with a side of the large hole section near the connecting portion.

4. The quick connect plug for cables according to claim 3, wherein section profiles of the plug-in unit and the stepped hole are round, waist-shaped, square, or elliptic.

5. A quick connect plug for cables, comprising:

a connecting portion configured to connect a cable and a plug pin configured to form a plug-in connection with a socket; wherein the plug pin is fixedly provided with a plug-in unit;

a portion of the plug-in unit protruding out of an external annular surface of the plug pin forms a locking head matched with a socket slot;

a gap is provided between a portion of the plug-in unit near the locking head and the plug pin, so as to enable the locking head to move along an axis direction of the plug pin, and the gap can limit a maximum displacement of the locking head;

wherein a first end of the plug-in unit protrudes out of the external annular surface of the plug pin to form the locking head, and a second end of the plug-in unit is fixedly connected to the plug pin;

wherein the plug pin is provided with a through hole, and the plug-in unit is a straight rod;

the straight rod comprises a large-diameter rod section and a small-diameter rod section;

the large-diameter rod section is inserted into the through hole to form an interference fit with the through hole; or the large-diameter rod section and the through hole are in a screw thread fit;

the small-diameter rod section passes through the through hole and extends out of the external annular surface of the plug pin to form the locking head; and a diameter of the small-diameter rod section is less than a diameter of the through hole.

6. The quick connect plug for cables, comprising:

a connecting portion configured to connect a cable and a plug pin configured to form a plug-in connection with a socket; wherein the plug pin is fixedly provided with a plug-in unit;

a portion of the plug-in unit protruding out of an external annular surface of the plug pin forms a locking head matched with a socket slot;

a gap is provided between a portion of the plug-in unit near the locking head and the plug pin, so as to enable the locking head to move along an axis direction of the plug pin, and the gap can limit a maximum displacement of the locking head;

wherein a first end of the plug-in unit protrudes out of the external annular surface of the plug pin to form the locking head, and a second end of the plug-in unit is fixedly connected to the plug pin;

wherein an end face of a side of the plug pin away from the connecting portion is provided with a recess;

the plug-in unit is plate-like and located in the recess;

the first end of the plug-in unit extends out of the external annular surface of the plug pin to form the locking head;

a side of the plug-in unit away from the connecting portion is provided with a pressing plate;

a side of the plug-in unit away from the locking head fits the pressing plate and is fixed on the plug pin with a screw; and the gap is formed between the portion of the plug-in unit near the locking head and the pressing plate.

7. The quick connect plug for cables according to claim 6, wherein the plug-in unit has a uniform thickness;

a side of the pressing plate near the locking head is wedge-shaped; or a plate thickness of the side of the pressing plate near the locking head is less than a plate thickness of a side of the pressing plate away from the locking head to form the gap.

8. The quick connect plug for cables according to claim 6, wherein the pressing plate has a uniform thickness, and the side of the plug-in unit near the locking head is wedge-shaped; or a plate thickness of the side of the plug-in unit near the locking head is less than a plate thickness of the side of the plug-in unit away from the locking head to form the gap.

* * * * *